US011655596B2

(12) United States Patent
Kieschnick, Sr.

(10) Patent No.: US 11,655,596 B2
(45) Date of Patent: May 23, 2023

(54) SPILL CONTAINMENT SYSTEM

(71) Applicant: ARMOR PONDS, LLC, Rockwall, TX (US)

(72) Inventor: Roger Kieschnick, Sr., Rockwall, TX (US)

(73) Assignee: ARMOR PONDS, LLC, Rockwall, TX (US)

( * ) Notice: Subject to any disclaimer, the term of this patent is extended or adjusted under 35 U.S.C. 154(b) by 0 days.

(21) Appl. No.: 17/014,855

(22) Filed: Sep. 8, 2020

(65) Prior Publication Data

US 2021/0071367 A1 Mar. 11, 2021

Related U.S. Application Data

(60) Provisional application No. 62/897,898, filed on Sep. 9, 2019.

(51) Int. Cl.
*E01B 19/00* (2006.01)
*B65D 1/34* (2006.01)

(52) U.S. Cl.
CPC ..... *E01B 19/006* (2013.01); *B65D 1/34* (2013.01)

(58) Field of Classification Search
CPC ..... E01B 19/006; E04H 6/428; F16N 31/002; F16N 31/006; B65D 90/428; B65D 1/34; B67D 7/3209
USPC ..... 220/573
See application file for complete search history.

(56) References Cited

U.S. PATENT DOCUMENTS

| | | | | |
|---|---|---|---|---|
| 9,874,374 | B1 * | 1/2018 | Gill | F16N 31/002 |
| 2012/0312821 | A1 * | 12/2012 | Matson | F16N 31/00 220/573 |
| 2016/0207704 | A1 * | 7/2016 | Schneider | B65D 11/186 |
| 2016/0281924 | A1 * | 9/2016 | Beak | F16N 31/002 |
| 2018/0065800 | A1 * | 3/2018 | Thurston | B08B 17/025 |
| 2021/0107732 | A1 * | 4/2021 | Bennett | B65D 90/24 |

* cited by examiner

*Primary Examiner* — Rafael A Ortiz
(74) *Attorney, Agent, or Firm* — Foley & Lardner LLP

(57) ABSTRACT

This disclosure presents a deployable spill containment system and method. In one embodiment, the spill containment device forms a shallow container covering a large area. The coverage area and depth may vary. The spill containment device may have deformable walls that allow vehicles to drive over and into the protection area during deployment. Furthermore, the spill containment device may be rolled, folded, or both, for storage and transportation, such as fitting in a bed of a pickup truck. The spill containment system includes replaceable components for easy repair, exchange, and modification when needed.

5 Claims, 9 Drawing Sheets

SPILL CONTAINMENT SYSTEM

CROSS-REFERENCE TO RELATED APPLICATION

This application claims priority to and benefit of U.S. Provisional Patent Application No. 62/897,898, filed Sep. 9, 2019, the contents of which are incorporated herein by reference in their entirety.

FIELD

This disclosure relates in general to spill containment, and in particular, a portable and deployable spill containment system for catching spills.

BACKGROUND

Spills of chemicals, oils, sewage and other liquids are oftentimes contained within a barrier system in order to avoid seepage into the surrounding areas (soil, rivers, lakes, etc.) to avoid contamination. Conventional spill containment devices or methods may use an inflatable stopper, metal frames or other configurations to support a spill proof surface. Such designs are easily damaged, difficult to store, transport or assemble

SUMMARY

This disclosure presents a deployable spill containment device, system, and method. In one embodiment, the spill containment device forms a shallow container covering a large area, such as, for example, an area of 11 feet (3.35 m) by 60 feet (18.29 m), for less than 12 inches (0.3 m) deep. The coverage area may vary, for example, to a smaller area such as 8 feet (2.44 m) by 8 feet (2.44 m), for 4 inches (0.1 m) deep. The spill containment device may have deformable walls that allow vehicles to drive over and into the protection area during and/or after deployment. Furthermore, the spill containment device may be rolled, folded, or both, for storage and transportation, such as fitting in a bed of a pickup truck. The spill containment system includes replaceable components for easy repair, exchange, and modification when needed.

In a first general aspect, a deployable spill containment device includes a pan made of a spill-proof material; an elastic entrance berm; and one or more side support berms, the one or more side support berms affixed to the pan and raising an edge of the pan to a predetermined height. In some embodiments, the one or more side support berms are spaced apart for a distance facilitating folding of the pan.

In one specific aspect, the elastic entrance berm is configured to be compressed to allow passage of a vehicle and to return to the original shape when unloaded. For example, a vehicle may drive over the elastic entrance berm, compressing it against the ground, and releasing the compression when it passes. The elastic entrance berm can then return to the original shape to maintain the containment depth of the pan.

In another specific aspect, the elastic entrance berm includes an elastic foam core and a spill-proof skin configured to wrap around the foam core and affixed to the pan and raising an edge of the pan to the predetermined height, in some embodiments, the spill-proof skin includes an adhesive strip to secure onto the foam core.

In yet another specific aspect, the spill-proof material may include closed cell polyethylene.

In one specific aspect, the elastic entrance berm and the one or more side support berms respectively include a high density crosslinked foam.

In another specific aspect, the pan is riveted onto an extended surface of the one or more side support berms and the elastic entrance berm to reach the predetermined height.

In yet another specific aspect, the pan is rectangular in shape and further including a second elastic entrance berm, in some embodiments, the elastic entrance berm and the second elastic entrance berm abut on opposing ends of two rows of the one or more side support berms to form the rectangular shape.

In one specific aspect, the elastic entrance berm and the one or more side support berms are at least 4 inches tall.

In a second general aspect, a foldable spill-proof pan includes a spill-proof surface having raised edges; a side support berm raising the edges to a predetermined height; and an entrance berm abutting the side support berm, the entrance berm configured to be compressed to allow for a vehicle to pass by.

In one specific aspect, the foldable spill-proof pan may further include a number of side support berms spaced apart for a distance facilitating folding for storage and transportation.

In another specific aspect, the number of side support berms has a height of about four to six inches.

In yet another specific aspect, the entrance berm is detachable from the side support berm such that the spill-proof surface is configured to be partially rolled upon the side support berm.

In one specific aspect, the edges of the spill-proof surface may be riveted onto an extended surface of the side support berm, in some embodiments, the extended surface is formed from an extra portion of spill-proof skin wrapped around and extending away from a foam core.

In another specific aspect, the spill-proof surface and the spill-proof skin are formed by closed cell polyethylene.

In a third general aspect, a method is disclosed for deploying a spill containment pond. The method includes: providing a number of side support berms; spacing the number of side support berms at a predetermined distance; attaching a first edge of a pan to some of the number of side support berms and raising the first edge of the pan to a predetermined height; providing an elastic entrance berm; abutting the elastic entrance berm to the number of side support berms at a distal end of the number of side support berms; and attaching a second edge of the pan to the elastic entrance berm and raising the second edge of the pan to the predetermined height.

In one specific aspect, providing the elastic entrance berm includes wrapping a spill-proof skin around a foam core and extending a portion of the spill-proof skin for attachment with the second edge of the pan.

In another specific aspect, spacing the number of side support berms at the predetermined distance is based on a number of folds and the predetermined height such that the predetermined distance accommodates one or more of the number of side support beams stacked when folded for storage and transportation.

In yet another specific aspect, providing the elastic entrance berm includes allowing the elastic entrance berm to be compressed upon receiving a compressive load and returning to an original shape to maintain the predetermined height of the second edge when the compressive load is removed.

In one specific aspect, attaching the first edge and the second edge includes riveting the first edge and the second edge of the pan to a respective extended spill-proof skin of the number of side support berms and the elastic entrance berm.

In another specific aspect, the predetermined height is about four to six inches and the predetermined distance is about eight to twelve inches.

Other aspects, features, and advantages will become apparent from the following detailed description when taken in conjunction with the accompanying drawings, which are a part of this disclosure and which illustrate, by way of example, principles of the inventions hereof.

DESCRIPTION OF THE FIGURES

The accompanying drawings facilitate an understanding of the various embodiments.

Like numerals refer to like elements.

DETAILED DESCRIPTION

This disclosure presents embodiments of a spill containment system. In general, a portable and deployable spill containment system (e.g., a shape of a pan or pond) for catching spills is described. The spill containment system is made of a spill-proof material such that it will not disintegrate when in contact with the spilled content, such as chemicals or fuels that would otherwise pollute the environment when absorbed into the ground. The spill containment system may be carried by one or more people and assembled/unfolded cover a large area, such as, for example, 11 feet wide by 60 feet long. The spill containment system may have, in some embodiments, a depth of about 4 inches to 6 inches, but may be customized to different depths. The depth of the spill containment system is provided by side supports that form a wall or a berm. The side support berms may be made of elastic and other resilient materials such that they can be reused and withstand substantial deformation, such as when being driven over by a vehicle. The side support berms raise and otherwise support edges of the pan to enable the pan to catch and temporarily contain spilled liquid. The spill containment system provides advantages, including withstanding of forces causes from large and heavy vehicles driving over the side berms, ease of configuration to cover different area sizes, ease of exchange or repair of components, and being easily and quickly foldable in a compact fashion for storage and transportation. Other advantages not expressly summarized may be understood from the detailed description below.

Figure 1:
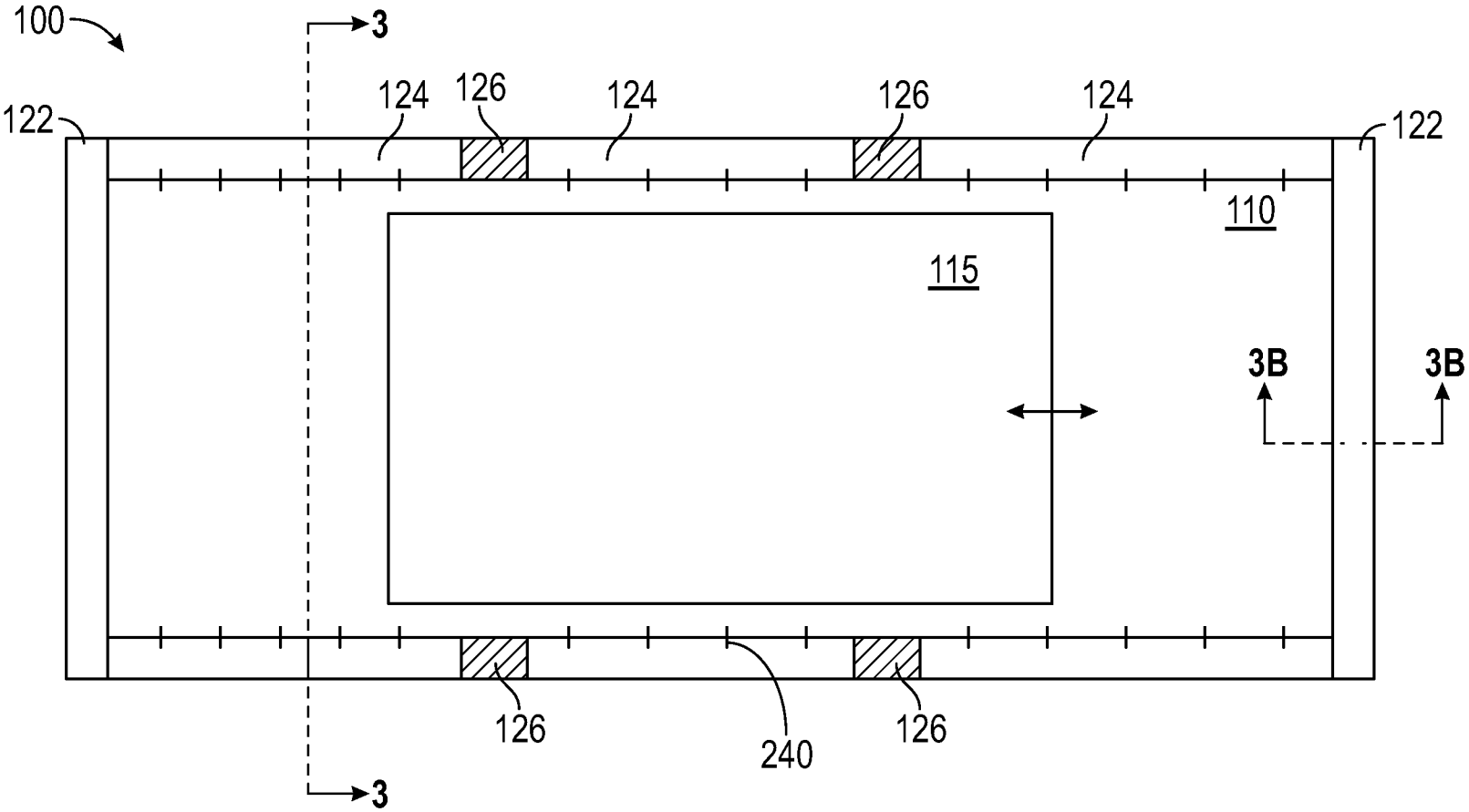
FIG. 1 is a top view of a spill containment system in a deployed configuration.

FIG. 1 is a top view of a spill containment system 100 in a deployed configuration to accommodate a vehicle 115 and/or any other type of equipment (a tank, a fuel trailer, fracking equipment, etc.) susceptible to leaking of fuels and/or other fluids during operation. The spill containment system 100 includes a pan 110 surrounded and supported by end or entrance berms 122 and a plurality of side berms 124. In the embodiment illustrated in FIGS. 1 and 2, the side berms 124 are spaced apart a predetermined distance to, as discussed in greater detail below, enable ease of folding for storage and/or transport. In the embodiment illustrated in FIGS. 1 and 2, a plurality of spaces 126 separate three side berms 124 on each side of the containment system 100; however, it should be understood that depending on the desired length of the containment system 100 and/or the respective sizes of the side berms 124, a different number of spaces 126 and/or berms 124 may be utilized.

With continued reference to FIG. 1, the end berms 122 extend laterally across the entirety of the containment system 100. The sidewall portion of the berms 122 at each end of the berm 122 connect or otherwise attach to respective ends of the side berms 124. In other embodiments, the end berms 122 extend between the side berms 124 such that the ends of the berms 122 abut the sidewalls of the berms 124 (not illustrated).

Figure 2:
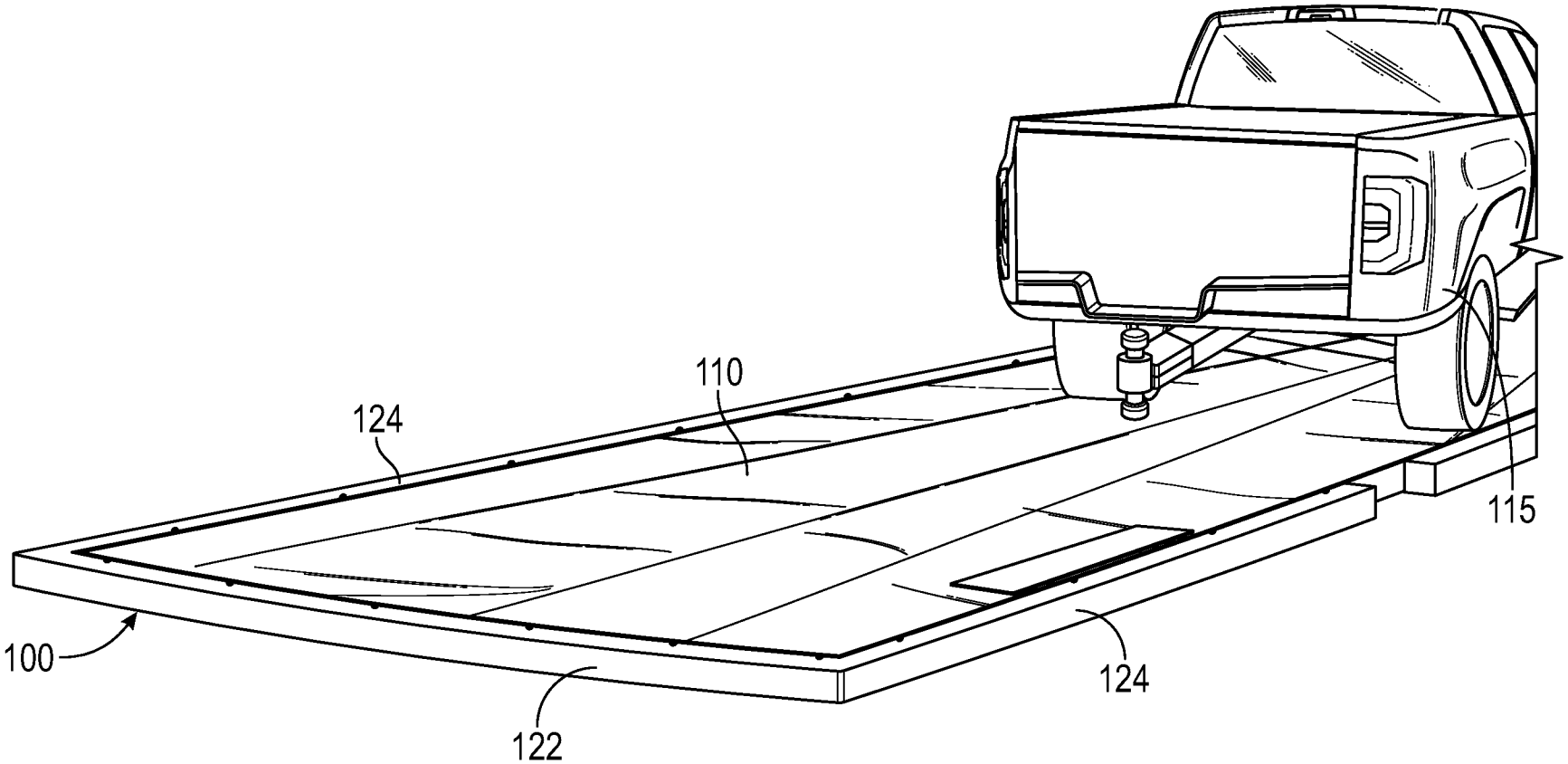
FIG. 2 is a perspective view of the spill containment system of FIG. 1.
Figure 3:
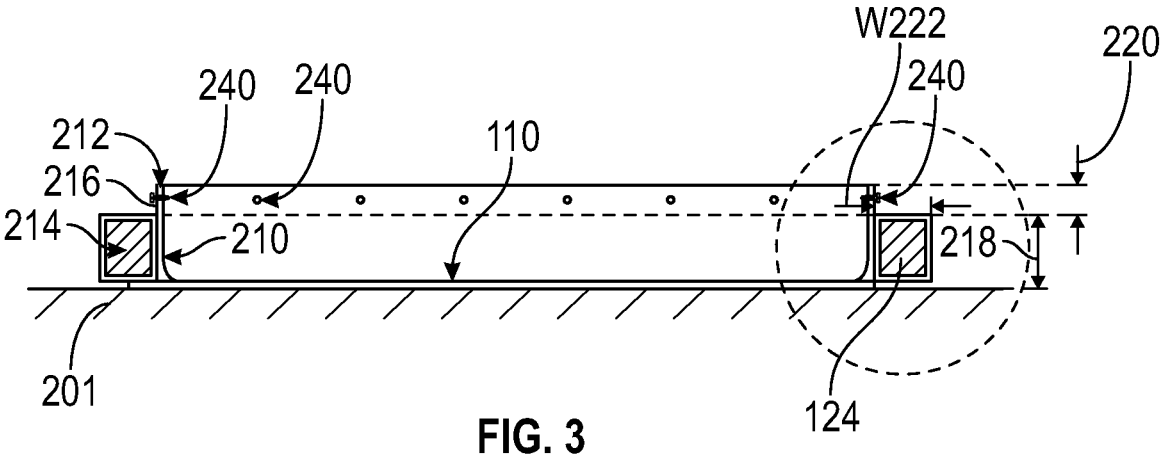
FIG. 3 is a cross sectional front view of the spill containment system of FIG. 1 taken along the line 3-3 of FIG. 1.
Figure 3A:
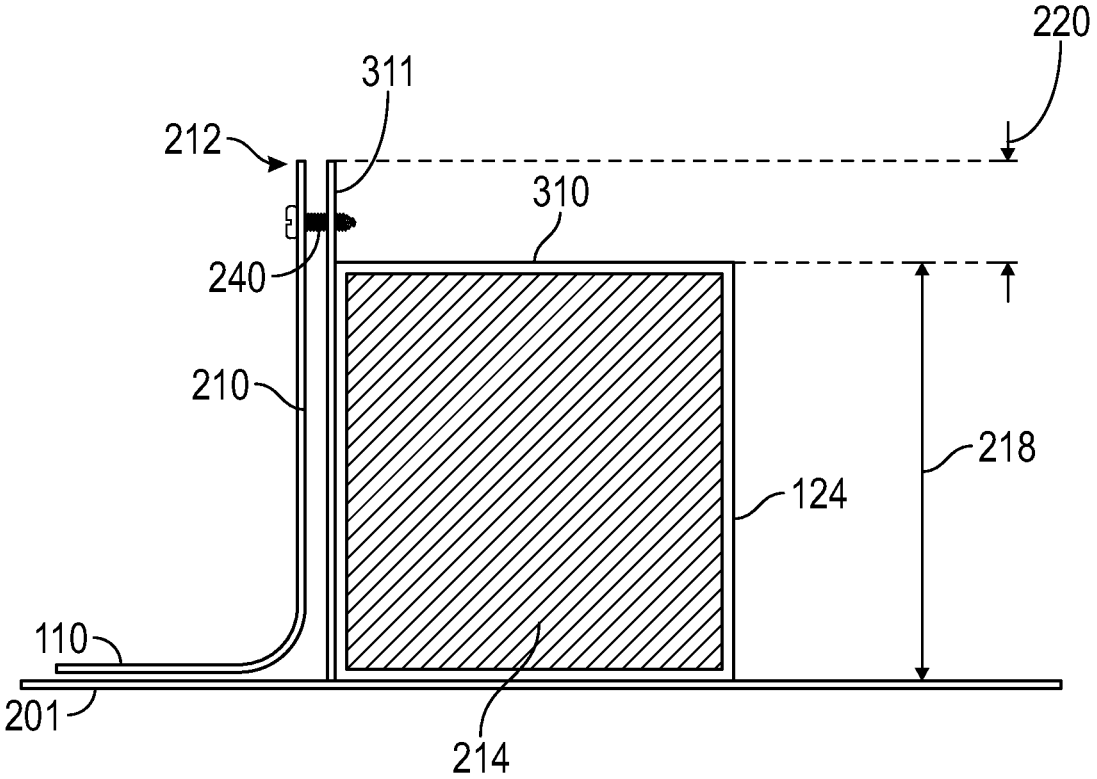
FIG. 3A is a detail view of the of a portion of the spill containment system of FIG. 3.

FIG. 3 is a cross sectional view of the spill containment system 100 taken along the line 3-3 of FIG. 1. FIG. 3A is a detail view of a portion of the containment system of FIG. 2. As shown in the embodiment illustrated in FIGS. 3 and 3A, the side support berms 124 are formed having a generally rectangular cross-sectional shape with a height 218, which is of a sufficient length to support the sidewall 210 of the pan 110. It should be understood that any cross-sectional shape (i.e., square, round, oval, etc.) may be utilized. As illustrated, the pan 110 rests on the ground 201 and has an edge 212 raised above the side support berms 124 by an extended height 220 to facilitate, as discussed in greater detail below, connection of the berms 124 to the pan 110.

Figure 4A:
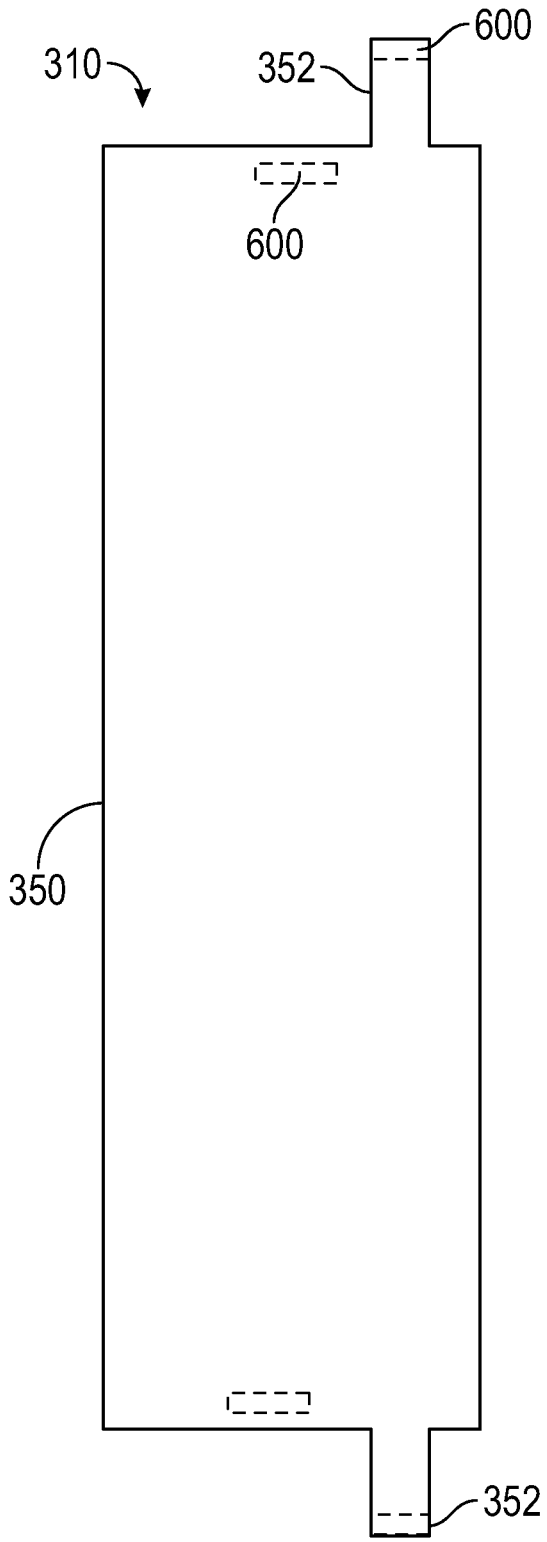
FIGS. 4A and 4B illustrate the outer skins of the berms of FIG. 1.

According to some embodiments, the side support berms 124 includes a core 214 wrapped or otherwise enclosed by a spill-proof skin 310 (e.g., the spill-proof skins 310 of FIG. 4A). In some embodiments, the core 214 is formed of a foam material such as, for example, a closed cell polyethylene foam or a high density crosslinked foam. However, it should be understood that the core 214 may be otherwise formed, including other types of foam and non-foam materials. In some embodiments, the core 214 may be an expandable/compressible bladder for holding air, water or any other type of fluid that is strong enough to support the pan sidewall 210 and contain liquids that are collected within the pan 110.

Referring to FIG. 3A, the skin 310 has an additional length/segment 311 extending beyond the perimeter of the side support berm 124 after it is wrapped around the core 214 to align and connect with the edge 212 and material adjacent the edge 212 of the pan 110. For example, the skin 310, and thus the berm 124, may be fastened to the pan 110 adjacent the edge 212 using a fastener 240 such as a rivet or screw, or by an adhesive, or via other attachment mechanisms such as Velcro™ to secure the segment 311 to the area adjacent the edge 212. In some embodiments, the edge segment 311 may also be sewed to the pan 110.

Figure 3B:
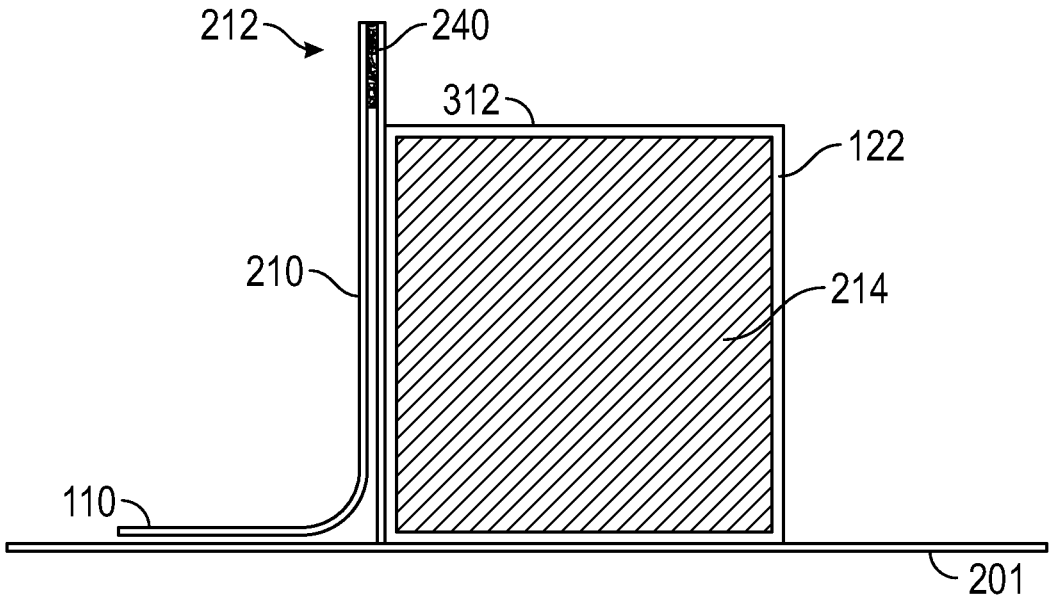
FIG. 3B is a section view taken along the line 3B-3B of FIG. 1
Figure 4B:
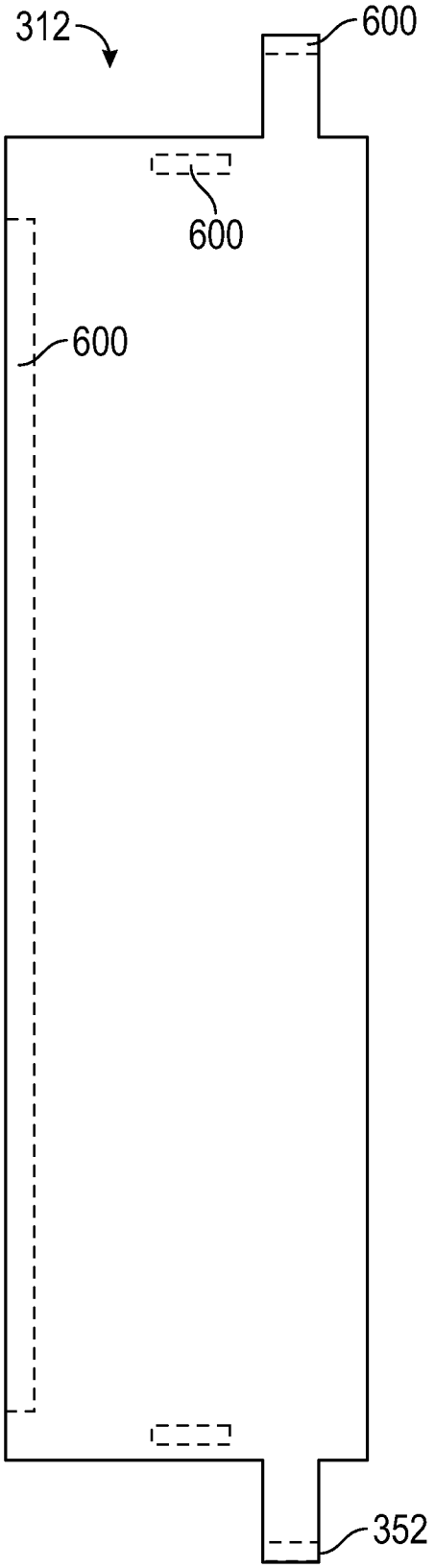

Referring to FIGS. 3B and 4B, a similar configuration is illustrated for the end berms 122. In particular, the skin 312 of the end berm 122 forms a tubular configuration similar to the tubular configuration of skin 310. In FIG. 4B, for example, the skin 312 has an additional length/segment 311 extending beyond the perimeter of the end berms 122 after it is wrapped around the core 214 to align and connect with the edge 212 and the area around the edge 212 of the pan 110. In FIGS. 3B and 4B, the skin 312 is preferably fastened to the pan 110 using a Velcro fastener 240 so as to facilitate ease of removal/separation of the berms 122 from the pan 110 when it is desired to fold and store the system 100.

Figure 5A:
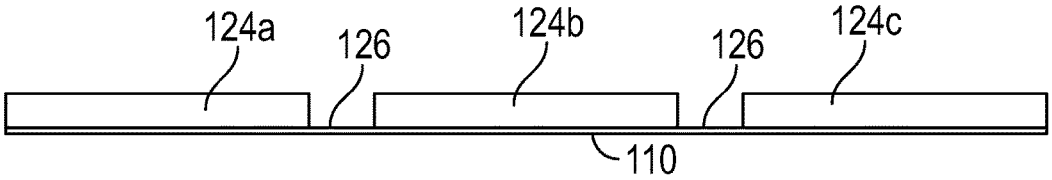
FIGS. 5A-5E illustrated the folding configuration of the containment system.
Figure 5B:
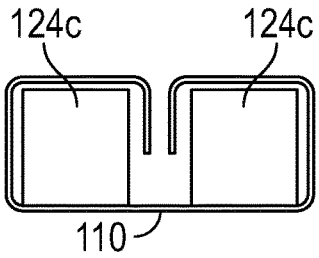
Figure 5C:
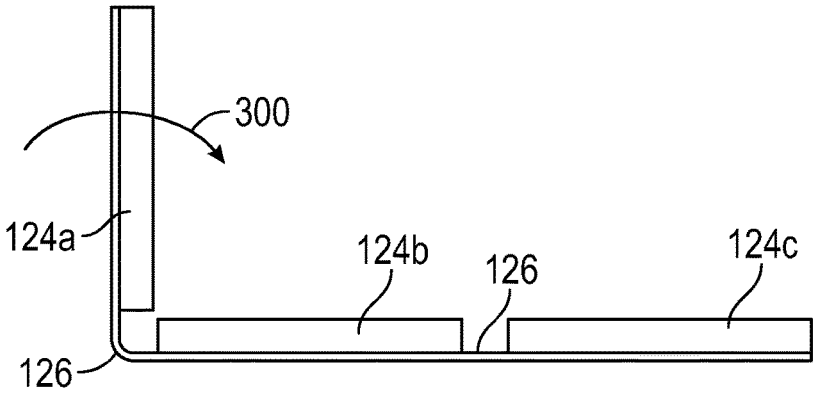
Figure 5D:
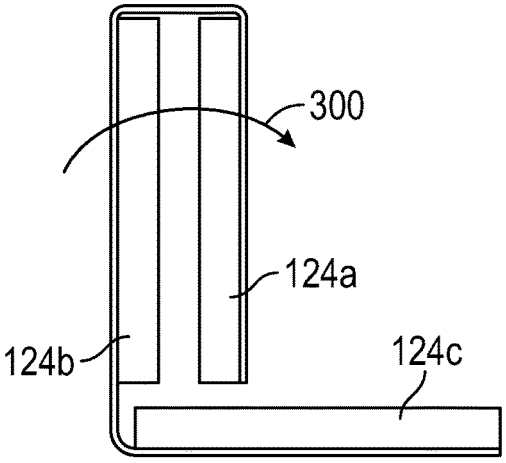
Figure 5E:
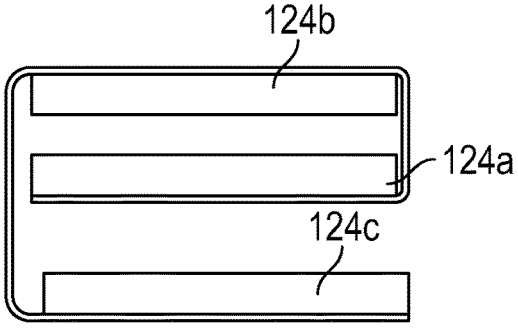
Figure 6:
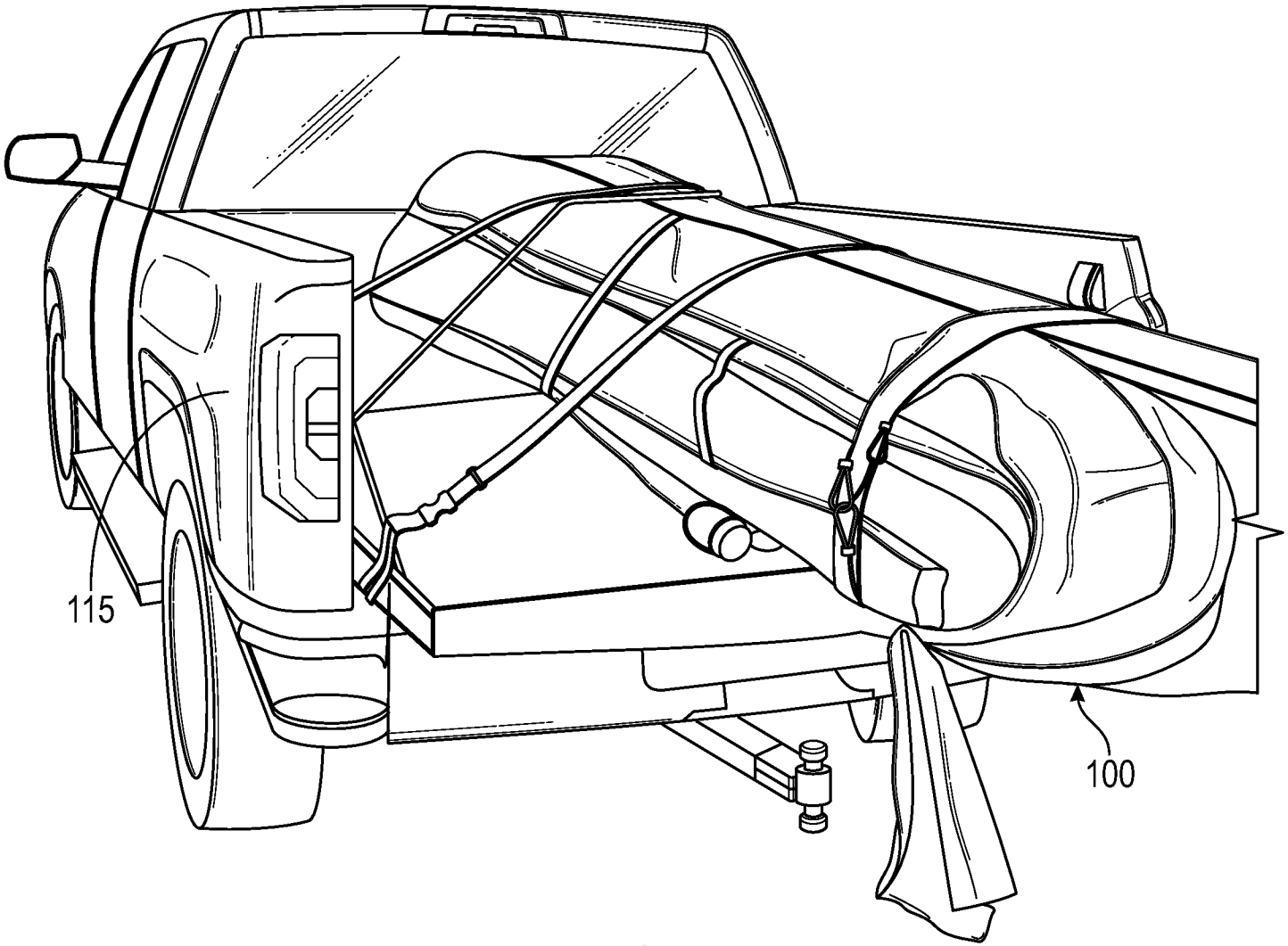
FIG. 6 is an example of the spill containment system in a folded configuration for compact transportation.

Referring back to FIGS. 1 and 2, the space 126 between the berms 124 is of a predetermined length to enable the open area created by the space 126 to act as a hinge as the side berms 124 are folded and stacked on top of each other when transitioning the pan 110 from the deployed position (e.g., FIGS. 1 and 2) to the folded position for storage or transport (e.g., FIG. 5A-5E). With specific reference to FIGS. 5A-5*e* (drawings not to scale), the method of folding the system 100 is illustrated. In FIGS. 5A and 5B, which illustrate respectively, a side view and end view of the system 100, the end berms 122 are detached from the pan 110 and the pan 110 is rolled up such that the side berms 124 are adjacent each other (FIG. 5B). Once in this position, berm 124*a* is rotated in the direction of arrow 300 until it is positioned on top of berm 124*b*. Once stacked in this configuration, the berms 124*a* and 124*b* are rotated together in the direction of arrow 300 (FIG. 5D) until they are stacked on top of the berm 124*c* (FIG. 5*e*) for ease of transport and storage. It should be understood that the process continues for each additional berm 124 in the event the containment system 100 is more than three berm lengths. Once folded in the storage position, the containment system 100 can be stored for transport, such as illustrated, for example, in FIG. 6. In order to set up, the above-described steps are performed in reverse order.

According to some embodiments, the extended height 220 may be about 1 inch (25.4 mm). In still other embodiments, the extended height 220 may be of a different value depending on the intended application.

During use, the vehicle 115 may move in and out of the pan 110 by directly driving into or out of the pan 110 crossing the entrance/end berms 122 on either end. The entrance berms 122 are formed so as to be elastically compressed in order to allow passage of a vehicle. The entrance berms 122 are formed to return to original shape after the compression loads have been removed. In some embodiments, like the side support berms 124, the entrance berms 122 include a core 214 and a spill-proof skin (e.g., the spill-proof skin 312 of FIG. 4B) wrapped around the core 214. The spill-proof skin is affixed to the side 210 of the pan 110 and raises the pan edges 212 to a predetermined height, such as, for example, 4 inches.

It should be understood that the height of the pan edges 212 can be higher or even lower, depending on the application. The entrance berms 122 may be 11 feet wide, or any width sufficient to cover a width of a truck. The entrance berms 122 may also have a square cross section profile having a side dimension of 4 inches, 6 inches, or the like.

In some embodiments, the spill-proof material includes closed cell polyethylene. In other embodiments, a tough, non-porous flexible film or sheet material may be used. The foam core may include a high density crosslinked foam that is elastic even after compression by a vehicle driven over. Although the entrance berms 122 function to return to its original shape, substantial return to its original shape is sufficient. As shown, the entrance berms 122 abut both ends of the two rows of the side support berms 124. When folded or otherwise not in use, the entrance berms 122 may be detached from the side support berms 124, or the pan 110, or both, until next deployment. Although the entrance berms 122 and the side support berms 124 are illustrated or described to have at least 4 inches in depth, different dimensions may be used or customized to specific use or projects.

Referring specifically to FIG. 4A, the skin 310 is configured to wrap around the core 214 to form the side berm 124 for use in the spill containment system 100 of FIGS. 1 and 2. The spill-proof skin 310 includes an edge 350 such that when assembling the skin 310, the edge 350 can be positioned adjacent to and secured along the attachment line 301 via an adhesive, a mechanical attachment (Velcro, buttons, etc.), sewing or any other method. Once the edge 310 is secured along the sew line 301, the skin 310 forming an open ended tube to receive the core 214 therein from either end. Once inserted therein, the ends 352 of the skin 310 are folded and otherwise positioned to enclose the ends of the tube. The ends 352 are secured to enclose the tube by Velcro 600 or any other suitable attachment means, as illustrated in FIG. 4A. According to some embodiments, the spill-proof skin 310 for the side support berm 124 may have an operational length of 9'4" and a total width of 18" for wrapping a foam core having a square cross-section of a side dimension of 4" and an extended height 220 for 1".

FIG. 4B is a schematic diagram illustrating spill-proof skin 312 configured to wrap around a foam core to form an elastic entrance berm 122 for use in the spill containment device 100 of FIG. 1. The overall dimensions are similar to the side berms 124 except that the elastic entrance berm 122 has an operational length of 11' instead of 9'4". As discussed above, the 11' operational length enables vehicles to drive over the entrance berm 122.

Referring back to FIG. 2, the deployment of the spill containment device 100 is illustrated with the vehicle 115 driven thereon. In some embodiments, the vehicle 115 and the foldable spill containment device 100 may together form a spill containment system. For example, the vehicle 115 may include a dedicated space for accommodating the folded spill containment device 100. In other embodiments, the foam cores for the entrance berms 122 and the side support berms 124 may be replaced using inflatable cores (for exchange, backup, replacement, or other purposes). The vehicle 115 may provide supply for equipment (such as pump) and power to operate such exchange.

Figure 7:
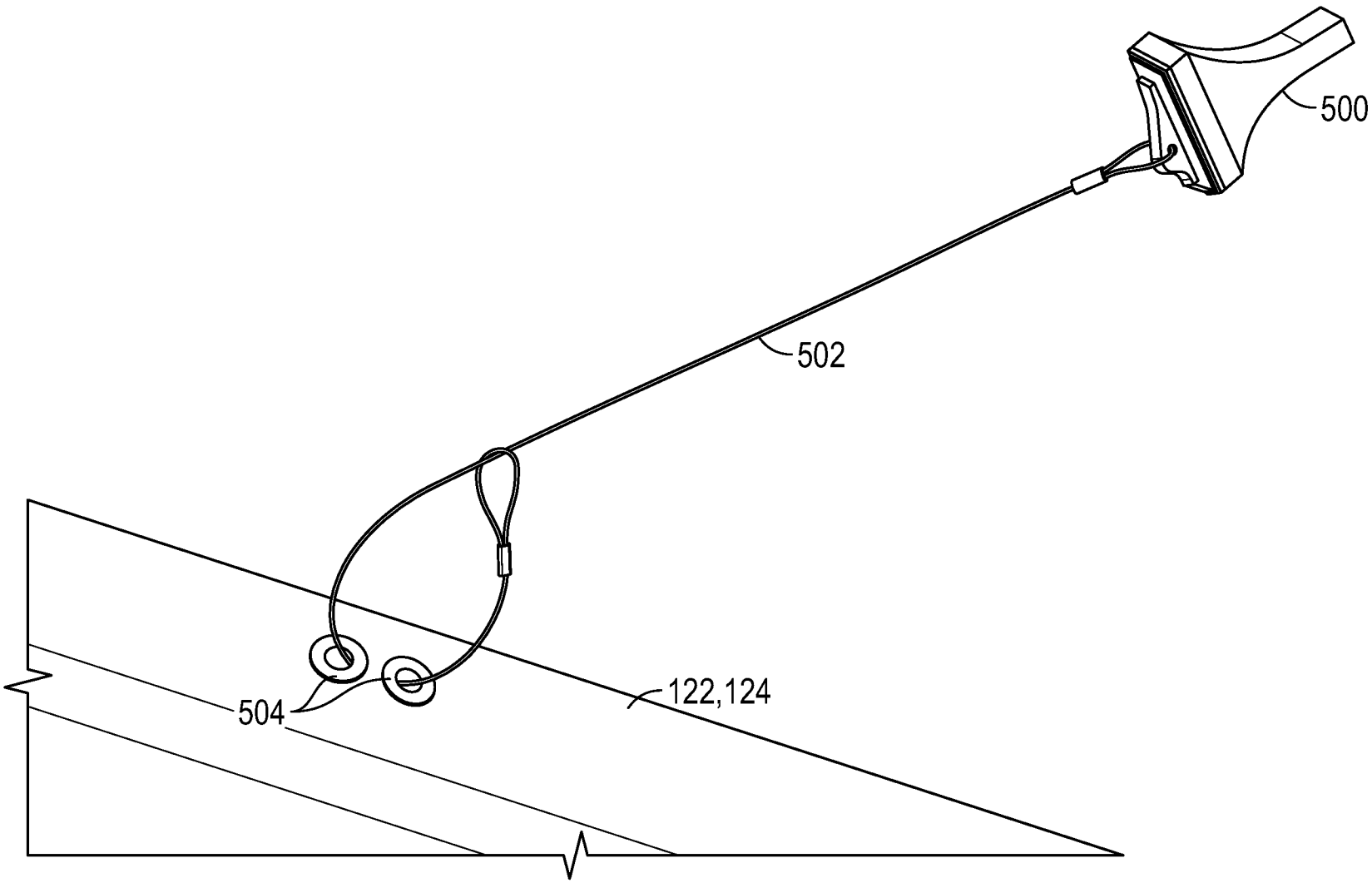
FIGS. 7 and 8 illustrate an embodiment of an anchoring device.
Figure 8:
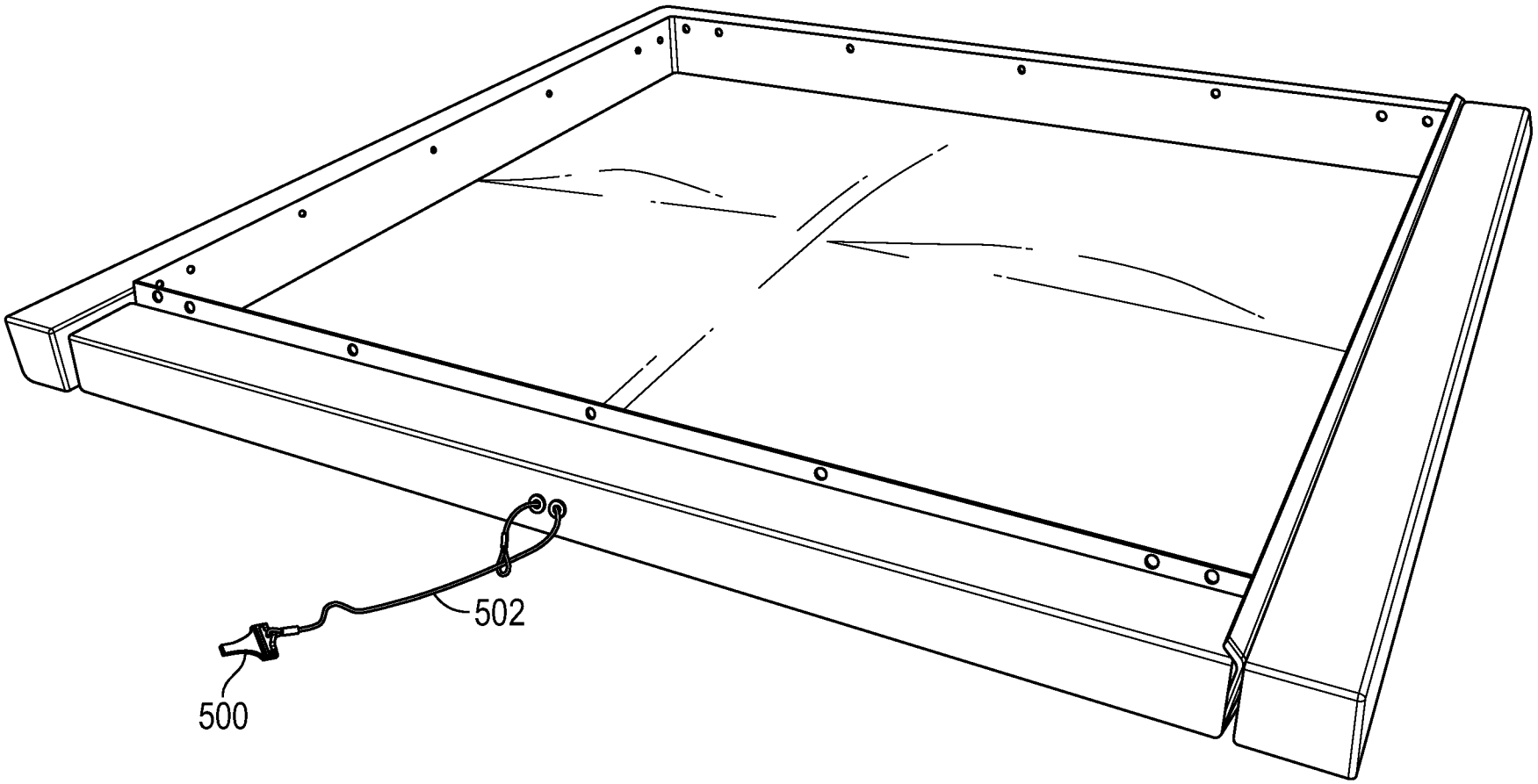

According to embodiments disclosed herein, the spill containment system 100 may be anchored down to the earth via a plurality of stakes or other types of anchors. For example, in some embodiments, all or select berms 122 and 124 may include one or more stakes 500 or other anchor devices that maintain the position of the system 100 relative to the earth, as seen for example in FIGS. 7 and 8. According to some embodiments, the stakes 500 can be that as described in U.S. Pat. No. 7,534,073, entitled "Earth Anchor", U.S. Design U.S. Pat. No. D572,546 entitled "Ground Anchor" and/or U.S. Pat. No. 8,011,860 entitled "Ground Anchor", each of which are hereby incorporated by reference in their entireties for all purposes. As illustrated in the embodiment shown in FIGS. 7 and 8, the stake 500 can be secured via a cable 502 through one more grommets 504 disposed on berms 122 and/or 124 to secure the system 100 to the earth.

Although only three side support berms 124 on each side of the pan 110 are illustrated in FIG. 1, in practice or in other embodiments, different number of the side support berms 124 may be used depending on the desired total dimensions. Similarly, the entrance berms 122 may be made of different dimensions, such as 8' instead of 11' depending on application.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose.

In the specification and claims, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s), as defined solely by the appended claims. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A foldable spill-proof pan comprising:

a spill-proof surface having a raised edge, the spill proof surface operable between a use position and a stored position;

wherein when in the use position, a first plurality of spaced apart side support berms are coaxially aligned and extend longitudinally along a first side of the spill-proof surface and a second plurality of spaced apart side support berms are coaxially aligned and extend longitudinally along a second side of the spill-proof surface;

an end berm disposed at a first end of the spill-proof surface and a second end berm disposed at a second and opposed end of the spill-proof surface, the end berms extending between the first and second sides of the spill-proof surface, the first and second end berms configured to be compressed to allow for a vehicle to pass over the end berms to enter into and exit from the spill proof pan;

the side support berms and the end berms are coupled to and support the raised edge to a predetermined height;

wherein the first and second plurality of the side support berms are each longitudinally spaced apart a predetermined distance such that the spill proof surface forms a hinge therebetween such that in the storage position, the predetermined distance enables each of the first and second plurality side support berms to be each folded in parallel relationship.

2. The foldable spill-proof pan of claim 1, wherein the first and second plurality of side support berms has a height of about four to six inches.

3. The foldable spill-proof pan of claim 1, wherein the end berms are detachable from the side support berms such that the spill-proof surface is configured to be partially rolled upon the side support berm.

4. The foldable spill-proof pan of claim 1, wherein the edges of the spill-proof surface are riveted onto an extended surface of the side support berms, wherein the extended surface is formed from an extra portion of spill-proof skin wrapped around and extending away from a foam core.

5. The foldable spill-proof pan of claim 4, wherein the spill-proof surface and the spill-proof skin are formed by closed cell polyethylene.

* * * * *